United States Patent [19]

Hauser et al.

[11] 4,312,932

[45] Jan. 26, 1982

[54] TONERS, DEVELOPERS FOR USE IN A SINGLE PASS COLOR IMAGE DEVELOPMENT

[75] Inventors: Oscar G. Hauser, Rochester; Frederick R. Ruckdeschel, Webster, both of N.Y.

[73] Assignee: Xerox Corporation, Stamford, Conn.

[21] Appl. No.: 179,370

[22] Filed: Aug. 18, 1980

[51] Int. Cl.[3] ..... G03G 9/10

[52] U.S. Cl. ..... 430/45; 430/106; 430/109

[58] Field of Search ..... 430/41, 42, 45, 106, 430/107, 108

[56] References Cited

U.S. PATENT DOCUMENTS

| | | | |
|---|---|---|---|
| 3,165,420 | 1/1965 | Tomanek et al. | 430/106 |
| 3,313,623 | 4/1967 | Bixby | 430/45 |
| 3,746,125 | 7/1973 | Hercock et al. | 430/45 |
| 3,804,619 | 4/1974 | Mammino et al. | 430/45 |
| 3,890,240 | 6/1975 | Hochberg | 430/106 |
| 3,909,259 | 9/1975 | Mammino et al. | 430/45 |
| 3,963,341 | 6/1976 | Tully | 430/44 |
| 4,066,563 | 1/1978 | Mammino et al. | 430/45 X |

*Primary Examiner*—Richard L. Schilling
*Assistant Examiner*—John L. Goodrow
*Attorney, Agent, or Firm*—E. O. Palazzo

[57] ABSTRACT

This invention relates to an improved color developing composition, the composition being comprised of toner resin particles, with each of said particles containing therein up to four pigments, and a single carrier. Suitable pigments include magenta, cyan, yellow or white, and/or mixtures thereof. The pigments are present in an amount of from about 1 percent (part) to about 20 percent by weight. Such compositions are useful in obtaining color images utilizing a single pass xerographic imaging system.

10 Claims, No Drawings

TONERS, DEVELOPERS FOR USE IN A SINGLE PASS COLOR IMAGE DEVELOPMENT

BACKGROUND OF THE INVENTION

This invention relates generally to toners useful in color imaging systems, and more specifically, to such toners and developers, wherein each of the toner resin particles contain therein the appropriate pigments. The developers of this invention are useful in a single pass electrophotographic color imaging systems, preferably a xerographic color imaging system.

The formation and development of images in an electrophotographic system, and more specifically a xerographic system is well known as described, for example, in U.S. Pat. No. 2,297,691. In such systems, several methods are used for applying the toner particles to the latent electrostatic image to be developed, such methods including cascade development, U.S. Pat. No. 2,618,552; magnetic brush development, U.S. Pat. No. 2,874,063; powder cloud development, U.S. Pat. No. 2,221,776; touchdown development, U.S. Pat. No. 3,166,432 and the like. Generally, the toners used in these types of systems result in the production of black images.

Recently there has been developed processes and materials for use in the formation of color images. Electrophotographic color systems are generally based on trichromatic color synthesis, such as the substractive color formation types. Accordingly, in electrophotographic color systems, toner or developing particles of at least three different colors are employed to synthesize any desired color. Generally, at least three color separation images are formed and the combined images registered with each other to form a colored reproduction of a full colored original. In color xerography as described, for example, in Dessauer U.S. Pat. No. 2,962,374, at least three latent electrostatic images are formed by exposing a xerographic plate to different optical color separation images. Each of the latent electrostatic images is developed with a different color toner, and subsequently the three toner images are combined to form the final full color image. This combination of three color toner images is generally made on a copy sheet such as paper to which the toner images are permanently affixed. One of the most common techniques for fixing these toner images to the paper copy sheet is by employing a resin toner which includes a colorant, and heat fixing the toner images to this copy sheet. Images may also be fixed by other techniques such as, for example, subjecting them to a solvent vapor.

In one known process an electrostatic latent image is exposed through a green filter to an imagewise projection of a color image to form an electrostatic latent image on the photoreceptor. This electrostatic latent image is then developed with the complimentary magenta color toner, to form a magenta colored image corresponding to said electrostatic latent image, and subsequently the image is transferred in register to an image receiving member. The photoreceptor is then electostatically charged uniformly in the dark, and exposed through a red filter to an imagewise projection of a color image in register with said magenta developed image, to form a second electrostatic latent image, which second image is developed with the complimentary cyan-colored toner and likewise transferred in register. The photoconductor is again electrostatically uniformly charged in the dark, and then exposed through a blue filter to an imagewise projection of a color image in register with said magenta and cyan developed images, to form a third electrostatic latent image which is then developed with the complimentary yellow toner and again transferred in register. The sequence of exposures through colored filters in this multiple development process may be performed in any suitable sequence other than the green, red and blue mentioned.

In these systems one important aspect resides in registration of the color toner image on the copy sheet, that is, the cyan, magenta, and yellow image should be in registration on the receiving member.

Generally, each developer used comprises a toner or resin colored mixture in combination with an appropriate carrier. The toners used must possess the appropriate color and continue to function under machine conditions which expose the developer to impaction and humidity among other undesirable factors. A three color system that has been well known and used in the past includes pigments of suitable cyan, magenta and yellow materials. One of the problems associated with the prior art processes is that it is necessary to use multiple passes, that is, three steps in development with three different colors, which can become cumbersome, uneconomical and slow. Other disadvantages of the prior art processes include the requirements that, (1) the photoreceptor be panchromatic, (2) the development response of each of the three toner developers be constant with usage, and (3) the transfer of the three different developed images be constant.

Also it is known in the prior art that the three color layers can be coated one on top of the other, the first layer being the magenta layer, the second being the cyan layer and the third being the yellow layer. Each subtractive color transmits two thirds of the spectrum and absorbs one third. The combination of cyan, magenta and yellow layers appears black, while the combination of magenta and yellow layers appears red, the combination of magenta and cyan layers appears blue and the combination of yellow and cyan layers appears green.

Further there is described in copending application, U.S. Ser. No. 080,625, filed Oct. 1, 1979, in the names of Oscar G. Hauser, and Frederick R. Ruckdeschel, developer compositions for use in color imaging systems, the compositions being comprised of a resin, a colorant selected from cyan, magenta, yellow, and mixtures thereof; and a single carrier. As described in the copending application, there is provided an appropriate blend of toners comprised of a cyan toner; resin and a cyan pigment, magenta toner, and/or a yellow toner, and mixtures thereof. The toner and developer of the present invention differs from the toner and developer of the copending application, in that said toner/developer consists of resin particles, each particle containing therein up to four pigments and preferably at least two pigments, as more fully defined hereinafter.

SUMMARY OF THE INVENTION

It is therefore an object of the present invention to provide toner resins containing therein up to four pigments.

Another object of the present invention is to provide colored toner particles, each of the particles containing therein up to four pigments, and the use of such toner for developing images in a color imaging system.

A further object of the present invention is the provision of developing materals containing toner resin particles, each of said particles containing therein the pigments cyan, magenta, and/or yellow, and a single carrier, wherein the pigments are blended together during toner fabrication. Such developing materials can be used to develop images of a large variety of single colors using a single pass xerographic imaging system. The use of a single pass system eliminates the requirement for precise registration of the transferred toner images.

These and other objects of the present invention are accomplished by providing an improved developer composition for use in color imaging or development systems, the composition comprised of toner resin particles, each of said resin particles containing therein up to four pigments, and a single carrier. It is important to emphasize that the pigments, that is, one pigment, two, three, or four pigments, are contained in each resin particle by for example, blending the pigments together in the molten resin polymer, during the processing and preparation of the toner resin which differs from blending each toner, that is, cyan toner (resin and a cyan pigment), with magenta toner, yellow toner, and/or white toner, as described in the copending application identified herein. Generally, there is combined with the single carrier a toner resin, comprised of resin particles, each of said resin particles containing up to four pigments, such as cyan, magenta, yellow, or white and mixtures thereof. In one preferred embodiment of the present invention the pigments employed are cyan, magenta, or yellow and mixtures thereof.

The percentage (or parts) of pigment or pigments present in each resin particle can vary depending on many factors including the shade of color desired, however, from about 1 percent to about 20 percent by total weight and preferably from about 5 to about 12 percent by weight of pigment is present, thus from about 80 percent to about 99 percent, and preferably from about 88 percent to about 95 percent by weight of resin is present. Accordingly, each resin particle can contain up to a total of 20 percent of pigment or pigments, therefore, for example, up to 20 percent and preferably up to 12 percent of cyan pigment can be present, 10 percent of cyan pigment and 10 percent of magenta pigment, 3 percent of magenta, pigment, 4 percent of cyan pigment, and 5 percent of yellow pigment, or 3 percent of cyan pigment, 3 percent of magenta pigment, 2 percent of yellow pigment, and 1 percent of white pigment, 12 percent of yellow pigment only, 10 percent of magenta pigment only, and the like.

The toner resins of the present invention are prepared for example by melt blending the resin particles with the pigment or pigments, using a twin shell mixing-blending apparatus followed by mechanical attrition, and optionally classification of the resultant particles. In one process there was mixed the toner resin 90 parts of styrene/n-butylmethacrylate copolymer resin, 58 percent styrene, 42 percent n-butyl methacrylate, 6.7 parts of blue pigment, 3.3 parts of permanent yellow, a green toner, in a 40 gallon drum for 0.5 hours at 11 revolutions per minute. Extrusion of the material was then accomplished employing a screw type extruder, at 250 revolutions per minute, followed by micronization in a 15 inch commercial micronizer, followed by classification in a Donaldson Model B classifier with a blower package. A similar procedure was utilized for preparing a red toner, containing 83 parts of a styrene/n-butyl methacrylate copolymer resin 58/42 13 parts of magenta pigment, 3.3 parts of permanent yellow pigment, and a blue toner containing 88 parts of styrene/n-butyl methacrylate copolymer resin 58/42, 9 parts of blue pigment and 3 parts of magenta pigment. In each instance there resulted colored toner particles, comprised of resin particles containing therein that is, in each resin particle the pigments indicated Illustrative example of different shades of color utilizing three pigments are as follows:

| Approximate Desired Color Shade | Parts of Cyan By Weight | Parts of Magenta By Weight | Parts of Yellow By Weight |
|---|---|---|---|
| 1. Yellowish Green | 1 | 0 | 7 |
| 2. Orange | 0 | 1 | 7 |
| 3. Green | 1 | 0 | 2 |
| 4. Blue Green | 2 | 0 | 1 |
| 5. Chocolate Brown | 1 | 2 | 2 |
| 6. Red | 0 | 1 | 1 |
| 7. Blue | 3 | 1 | 0 |
| 8. Red | 0 | 2 | 1 |
| 9. Orange (Light) | 0 | 1 | 2 |
| 10. Blue | 1 | 1 | 0 |

Illustrative examples of magenta materials which may be used as pigments include 2,9-dimethyl substituted quinacridone, an anthraquinone dye identified in the Colour Index as CI 60710, CI Dispersed Red 15, a diazo dye identified in the Colour Index as CI 26050, CI Solvent Red 19, and the like.

Illustrative examples of cyan materials that may be used as pigments include copper tetra-4-(octadecylsulfonomido) phthalocyanine, an X-copper phthalocyanine pigment listed in the Colour Index as CI 74160, CI Pigment Blue 15, an indanthrene blue identified in the Colour Index as CI 69810, Special Blue X-2137, and the like.

Illustrative examples of yellow materials that may be used as pigments include diarylide yellow 3,3-dichlorobenzidene acetoacetanilide, a monoazo dye identified in the Colour Index as CI 12700, CI Solvent Yellow 16, a nitrophenylaminesulfonamide identified in the Colour Index as Foron Yellow SE-GLF, CI Dispersed Yellow 33, and the like.

Illustrative examples of white materials that may be used as pigments include titanium dioxide, and the like.

Several single suitable carrier materials can be employed including but not limited to sodium chloride, ammonium chloride, granular zinc, silicon dioxide, methyl methacrylate, nickel, glass, steel, iron ferrite and the like. Coated carrier materials may also be used, including for example the above mentioned carriers coated with organic materials such as fluorinated polymers, including polyvinylidene fluoride. Many of the carriers that can be use are described in U.S. Pat. Nos. 2,618,441, 2,638,416, 3,591,503, 3,533,835, and 3,526,533. Also nickel berry carriers as described in U.S. Pat. Nos. 3,847,604 and 3,767,598 can be employed, these carriers being nodular carrier beads of nickel characterized by surfaces of recurring recesses and protrusions providing particles with a relatively large external area. It is important that the carrier that is selected establishes the appropriate triboelectric relationship with the resin that is used, which resin is described in detail hereinafter, in order to enable it to function effectively in an electrophotographic imaging mode. Generally, the carrier ranges in size from about 35 microns in diameter to about 250 microns and preferably from about 80 microns to about 150 microns. The amount of carrier present can vary depending on many factors, including for example the mass density of the carrier; generally, however, about 0.5 percent to about 5 percent, by weight and preferably 1 percent to 3 percent, by weight of carrier is present in the developer mixture.

The pigment materials cyan, magenta, yellow, and/or white may be combined with numerous suitable resins including but not limited to thermoplastics like olefin polymers such as polyethylene and polypropylene; polymers derived from dienes such as polybutadiene, polyisobutylene, and polychloroprene; vinyl and vinylidene polymers such as polystyrene, styrene butylmethacrylate copolymers, styrene-acrylonitrile copolymers, acrylonitrile butadiene styrene terpolymers, polymethylmethacrylate, polyacrylates, polyvinyl alcohol, polyvinyl chloride polyvinyl carbazole, polyvinyl ethers, and polyvinyl ketones, fluorocarbon polymers such as polytetrafluoroethylene and polyvinylidene fluoride; heterochain thermoplastics such as polyamides, polyester, polyurethanes, polypeptides, casein, polyglycols, polysulfides, and polycarbonates; and cellulosic copolymers such as regenerated cellulone, cellulose acetate and cellulose nitrate. Generally resins containing a relatively high percentage of styrene are preferred, such as homopolymers of styrene or styrene homologs of copolymers of styrene, with other monomeric groups containing a single methylene group attached to a carbon atom by a double bond. One preferred resin used in the present invention is a copolymer resin of styrene and n-butyl methacrylate, when the percentage of styrene is 58, or 65, and the percentage of n-butyl methacrylate is 42 or 35.

The developers of the present invention can be employed to develop images in color imaging systems utilizing various inorganic, and organic photoreceptors. Examples of inorganic photoconductor materials include but are not limited to sulfur, selenium, zinc sulfide, zinc oxide, zinc cadmium sulfide, zinc magnesium oxide, cadmium selenide, zinc silicate, calciumstrontium sulfide, cadmium sulfide indium trisulfide, gallium triselenide, arsenic disulfide, arsenic trisulfide, arsenic triselenide, antimony trisulfide, cadmium sulfoselenide and mixtures thereof. Typical organic photoconductors include but are not limited to triphenyl-amine; 2,4-bis(4,4'diethyl aminophenyl)-1,3,4-oxadiazol; N-isopropylcarbazole triphenylpyrrol; 4,5-diphenyl-imidazolidinone; 4,5-diphenyl-imidazolidine thione; 4,-5-bis-(4'amino-phenyl)imidazolidinone; 1,5-dicyanonaphthalene 1,4-dicyanonaphthalene; aminophthalodinitrile; nitrophthalodinitrile; 1,2,5,6-tetraaza-N-isopropylcarbazole triphenylpyrrol; 4,5-diphenylimidazolidinone; 4,5-diphenylimidazolidinethione; 4-5-bis-(4'-amino-phenyl)-imidazolidione; 1,5-dicyanonaphthalene; 1,4-dicyanonaphthalene; 1,4-dicyanonaphthalene; aminophthalodinitrile; nitrophthalodinitrile; 1,2,5,6-tetraazacyclooctatetranene-(2,4,6,8); 2-mercapto-benzathiazole; 2-phenyl-4-diphenylidene-oxazolone; 6-hydroxy-2,3-di(pmethoxyphenyl)-benzofurane; 4-dimethyl-aminobenzylidene-benzhydrazide; 3-benzylidene-amino-carbazole; polyvinyl carbazole; (2-nitrobenzylidene)p-bromo-aniline; 2,3-diphenyl quinazoline; 1,2,4-triazine; 1,5-diphenyl-3-methyl-pyrazoline; 2-(4'-dimethylaminophenyl)-benzoxazole; 3-aminocarbazole; phthalocyanines; trinitrofluoronone polyvinyl carbazole; charge transfer complexes and mixtures thereof.

Numerous suitable methods of charging may be employed including corona charging, charge deposition resulting from air breakdown in the gap commonly referred to as TESI charging in vacuum with an electron gun.

Numerous suitable methods of exposure may be employed in color imaging systems using the developers of the present invention including reflex, contact, holographic techniques, non-lens slit scanning systems, and optical projection systems involving lens imaging of opaque reflective subjects as well as transparent film originals.

Numerous suitable methods of development may be employed in color imaging systems using the developers of the present invention including cascade development, magnetic brush development, and the like.

Numerous suitable methods of fixing may be employed in color imaging systems using the developers of the present invention including heat-pressure fusing, conductive and convection fusing, such as oven fusing, solvent fusing, and a combination of heat, pressure solvent fusing.

The above mentioned developers were found to perform exceptionally well when used for the production of color xerographic prints from an original. There was no degradation of the triboelectric properties of the developer, nor unacceptable imaging due to impaction, and other problems associated with prior art developers. In one embodiment the developer of the present invention is provided from a developer housing in an automatic color electrophotographic imaging machine. The photoconductive member contained in the imaging machine is selectively exposed to light of the primary colors, or one of the primary colors, developed with the developer of the present invention, transferred to a suitable substrate, such as paper, and then fused.

The developers of the present invention are especially useful in flat color copying systems. The term flat color is well known in the art, thus for example in the printing industry, flat color copying is accomplished by effecting multiple passes of the output print, through a printing press. Each pass of the print results in the production of a different color. Gradations of value or darkness, and chroma, or saturation are obtained by halftoning techniques, however, gradations of hue during a single pass does not result. Accordingly, the colors on the output print are usually of a uniform shade, and of a uniform darkness, and the number of hues represent the number of passes, by the output document through the press.

The invention will now be described in detail with respect to specific preferred embodiments thereof, it being understood that these examples are intended to be illustrative only and the invention is not intended to be limited to the materials, conditions, process parameters, etc. recited herein. All parts and percentages are by weight unless otherwise indicated.

EXAMPLE I

There was prepared by melt blending followed by mechanical attrition, a green colored toner by mixing together 90 parts by weight of a styrene-n-butyl methacrylate copolymer resin, 58 percent sytrene, 42 percent n-butyl methacrylate (58/42), 6.7 parts of the pigment copper tetra-4-(octadecylsulfonomido)phthalocyanine, and 3.3 parts of the pigment diarylide yellow, 3,3-dichlorobenzidene aceto acetanilide. There resulted a toner of resin particles containing in each particle the pigments indicated.

The resultant green colored toner blend 97 parts by weight is mixed with 3 parts by weight of a steel carrier. The resultant developer is then employed in a commercial automatic xerographic color apparatus, and excellent color copies of high resolution result after a single development sequence.

The developer produced can also be used in a magnetic brush developer system, which system is positioned around the selenium photoreceptor. The selenium photoreceptor is charged to a positive potential of +1000 volts, and exposed to an image. The latent electrostatic image formed on the photoreceptor is developed with the above developer by engaging the developer housing into development configuration with the photoreceptor. The image on the photoreceptor is then transferred to a receiver sheet in register. The photoreceptor is cleaned of the residual toner and is then ready for a subsequent exposure. The receiver sheet containing the green toner is then heat fused.

The above processes was repeated numerous times, and 75,000 color prints of good contrast, color and quality were produced.

EXAMPLE II

The procedure of Example I is repeated with the exception that a red colored toner was prepared by mixing together with 83.5 parts by weight of the styrene/n-butyl methacrylate copolymer resin, 13.2 parts of the magenta pigment 2,9-dimethyl substituted quinacridone, and 3.3 parts of the diarylide yellow pigment of Example I.

A developer was prepared in accordance with Example I, with the exception that a nickel berry carrier was used in place of the steel carrier. When this developer was used in a commercial automatic xerographic color machine, or with the magnetic brush developer system of Example I, substantially similar results were obtained, that is, excellent color copies of high resolution after a single development sequence; and color prints of good contrast, color, and quality were produced when a magnetic brush developer system was used.

EXAMPLE III

The procedure of Example I is repeated with the exception that a blue colored toner was prepared by mixing together with 88 parts by weight of the styrene/n-butyl methacrylate resin of Example I, 9 parts of the copper pigment of Example I, and 3 parts of the magenta pigment of Example II.

A developer material was prepared in accordance with Example II and substantially similar results were obtained when the developer was used in a commercial automatic xerographic color machine, or with the magnetic brush developer system of Examples I or II.

Other modifications of the present invention will occur to those skilled in the art upon a reading of the present disclosure. These are intended to be included within the scope of this invention.

What is claimed is:

1. An improved developer composition for use in a single pass color imaging system, the composition consisting essentially of toner resin particles and a single carrier material, each of the resin particles containing therein from about 1 percent to about 20 percent by weight, three pigments, said pigments being selected from the cyan pigment copper tetra-4-(octadecylsulfonomido) phthalocyanine, the magenta pigment 2,9-dimethyl substituted quinacridone, the yellow pigment diarylide yellow 3,3-dichlorobenzidene aceto acetanilide or mixtures thereof.

2. An improved developing composition in accordance with claim 1 wherein the resin is a styrene/n-butylmethacrylate copolymer.

3. An improved developer composition in accordance with claim 1, wherein from about 5 to about 12 percent by weight of pigment is present and from about 88 percent to about 95 percent by weight of resin is present.

4. An improved developer composition in accordance with claim 1 wherein 6 parts by weight of the pigment copper tetra-4-(octadecylsulfonomido)phthalocyanine is present and 3 parts by weight of the pigment diarylide yellow 3,3-dichlorobenzidene aceto acetanilide is present thereby resulting in a green colored toner.

5. An improved developer in accordance with claim 1 wherein there is present 13 parts of the magenta pigment 2,9-dimethyl substituted quinacridone, and 3.3 parts of the diarylide yellow 3,3-dichlorobenzidene aceto acetanilide, thereby resulting in a red colored toner.

6. An improved developer composition in accordance with claim 1 wherein there is present 9 parts of the pigment copper tetra-4-(octadecylsulfonomido)phthalocyanine, and 3 parts of the magenta pigment 2,9-dimethyl substituted quinacridone, thereby resulting in a blue colored toner.

7. A method for obtaining colored images utilizing a single pass xerographic imaging system which comprises charging the photoreceptor contained in the imaging system, followed by imagewsie exposure of said photoreceptor, and developing the resulting image with the developer composition of claim 1, followed by transferring the image to a suitable substrate and permanently affixing the image thereto.

8. A method in accordance with claim 7 wherein the resin particles are a styrene/n-butylmethacrylate copolymer, and contained in each resin particle up to at least three pigments selected from the cyan pigment copper tetra4-(octadecylsulfonomido)phthalocyanine, the magenta pigment 2,9-dimethyl substituted quinacridone, the yellow pigment diarylide yellow 3,3-dichlorobenzidene aceto acetanilide or mixtures there, and the carrier material is steel.

9. A method in accordance with claim 8 wherein from about 1 percent to about 20 percent by weight of the pigment is present and from about 80 percent to about 99 percent by weight of the resin is present.

10. A method in accordance with claim 9 wherein from about 5 to 12 percent by weight of the pigment is present and from about 88 percent to 95 percent by weight of the resin is present.

* * * * *